US008205475B2

(12) United States Patent
Stork

(10) Patent No.: US 8,205,475 B2
(45) Date of Patent: Jun. 26, 2012

(54) WARM-FORMING A1 LUBRICANT

(76) Inventor: David J. Stork, Fenton, MI (US)

( * ) Notice: Subject to any disclaimer, the term of this patent is extended or adjusted under 35 U.S.C. 154(b) by 0 days.

(21) Appl. No.: 13/022,649

(22) Filed: Feb. 8, 2011

(65) Prior Publication Data

US 2011/0126604 A1 Jun. 2, 2011

Related U.S. Application Data

(63) Continuation of application No. 12/050,200, filed on Mar. 18, 2008, now abandoned.

(60) Provisional application No. 60/919,399, filed on Mar. 22, 2007.

(51) Int. Cl.
*B21B 45/00* (2006.01)

(52) U.S. Cl. ..... 72/47; 72/42

(58) Field of Classification Search ..... 72/41, 42, 72/46, 47; 508/150, 165, 172, 181, 591
See application file for complete search history.

(56) References Cited

U.S. PATENT DOCUMENTS

| | | | | |
|---|---|---|---|---|
| 2,866,262 | A | | 12/1958 | Mataich et al. |
| 3,269,943 | A | | 8/1966 | Armstrong et al. |
| 3,271,986 | A | | 9/1966 | Stulen |
| 3,557,687 | A | | 1/1971 | Grinpress |
| 4,088,585 | A | | 5/1978 | Karpen |
| 4,148,204 | A | | 4/1979 | Doetzer et al. |
| 4,222,260 | A | | 9/1980 | McDermott |
| 5,141,659 | A | * | 8/1992 | Kashiwaya et al. ..... 508/137 |
| 5,244,587 | A | * | 9/1993 | Ito et al. ..... 508/138 |
| 5,538,566 | A | | 7/1996 | Gallagher, Jr. |
| 6,006,564 | A | * | 12/1999 | Frisby et al. ..... 72/41 |
| 6,329,329 | B1 | | 12/2001 | Sharp et al. |
| 6,550,302 | B1 | | 4/2003 | Ghosh |
| 7,030,065 | B2 | | 4/2006 | Lockett, Sr. |
| 7,140,224 | B2 | | 11/2006 | Luo et al. |
| 7,354,234 | B2 | | 4/2008 | Fujishige et al. |
| 7,730,753 | B2 | | 6/2010 | Krajewski et al. |

FOREIGN PATENT DOCUMENTS

JP 3-250098 * 11/1991

OTHER PUBLICATIONS

Ghosh, Amit, et. al., "Tensile Deformation Behavior of Aluminum Alloys at Warm Forming Temperatures," Material Sci. & Engr. v. 352 1-2, pp. 279-286.

* cited by examiner

*Primary Examiner* — Edward Tolan
(74) *Attorney, Agent, or Firm* — Brooks Kushman P.C.

(57) ABSTRACT

Aluminum, magnesium, and steel can be warm formed through use of a solid, warm forming lubricant which is a metal or metal alloy, or high melting temperature polar polymer. The parts can be painted directly after warm forming.

19 Claims, No Drawings

WARM-FORMING A1 LUBRICANT

CROSS-REFERENCE TO RELATED APPLICATIONS

This application is a continuation of U.S. application Ser. No. 12/050,200 filed Mar. 18, 2008, now abandoned, which, in turn, claims the benefit of U.S. provisional Application Ser. No. 60/919,399, filed Mar. 22, 2007. The disclosures of which are incorporated in their entirety by reference herein.

BACKGROUND OF THE INVENTION

1. Field of the Invention

The invention pertains to lubricants for the warm-forming of metals, particularly titanium, steel, and aluminum, and magnesium and their alloys, and paintable products obtained thereby.

2. Background Art

Many stamped products are cold formed, i.e., stamped between male/female mold halves at temperatures close to ambient. For parts with modest depth and gentle contours, the method works well. However, for parts of deeper section, particularly those of complex shape, this method has proven inadequate. In parts of aluminum and magnesium in particular, the metal tends to gall, tear, fracture, or exhibit poor surface quality. Thus, warm-forming techniques have been developed. Warm forming is well known in the art. See, e.g. the Handbook Of Aluminum, G. E. Totten et al., CRC Press, 2003, which is incorporated for this purpose herein.

Warm-forming takes place at considerably elevated temperatures, yet at temperatures below the melting point of the alloy being formed. With aluminum alloys, for example, temperatures of the alloy precursor may range from 600° F. to 1000° F. Under these conditions, the alloy loses considerable strength and modulus, but becomes more ductile. These qualities are needed to form deep sections. However, aluminum, and in particular magnesium, are generally warm formed at considerably lower temperatures, for example in the range of 200° C. to 320° C. Magnesium warm forms well at 225° C., since at this temperature, additional slip planes are generated in the lattice.

However, the warm-forming process is also subject to galling and poor surface quality. These problems may be eliminated through the use of a suitable lubricant. However, because of the elevated temperatures, any lubricant must not only be thermally stable, but must also retain its lubricant qualities at the forming temperatures. Thus, lubricant oils, while somewhat effective in cold-forming, loose their viscosity and a great deal of their lubricity at elevated temperatures.

Many deep drawn parts, such as those for the transportation sector, must subsequently be painted. It is important that the lubricant may either easily be removed by simple, cost-effective processes, or preferably, need not be removed at all, while not impairing paintability. Polyethylene waxes and powders, for example, provided heating time is short, may serve as lubricants. However, polyethylene is not paint receptive, and must be removed. Aqueous washes are incapable of thorough removal, requiring a warm organic solvent rinse. Such rinses are environmentally disfavored, and disfavored for safety and cost reasons as well.

SUMMARY OF THE INVENTION

It has now been surprisingly discovered that warm-forming of metals may take place with a lubricant which is a high melting point polar polymer, a high melting alloy, or a combination thereof. In one embodiment, the lubricant need not be removed following the forming process. In another embodiment, the lubricant is removed by a conventional water wash. In a further embodiment, a plurality of lubricants with different melting points are employed.

DETAILED DESCRIPTION OF THE PREFERRED EMBODIMENT(S)

The warm-forming temperature selected is generally the minimum which allows a section to be formed while maintaining the desired surface qualities, freedom from fractures, "hole-throughs," and the like. While higher temperatures may be used, energy costs dictate that a minimal temperature be employed whenever possible. The temperatures employed will vary with the particular alloy used, and also with its processing history, for example its heat treatment regime. In general, temperatures between 400° F. (200° C.) and 1000° F. (537.8° C.) are employed, more preferably 700° F. (371.1° C.) to 1000° F. (537.8° C.), yet more preferably 800° F. (426.68° C.) to 950° F. (510° C.), and most preferably in the range of 850° F. (454.44° C.) to 950° F. (510° C.), with respect to aluminum alloys. These temperatures, as well as the warm forming temperatures of various alloy steels and magnesium alloys are well known. Warm forming always takes place below the melting point or range of the alloy, preferably at a temperature which is bellow the melting point by at least 50° C., more preferably 400° C. to 200° C. below the melting point. Reference may be had to Amit Ghosh et al., "Tensile Deformation Behavior of Aluminum Alloys at Warm Forming Temperatures," Material Sci. & Engr., v. 352, 1-2, pp 279-86, and Ghosh U.S. Pat. No. 6,550,302, both incorporated herein by reference. For warm forming of steel, reference may be had to U.S. Pat. No. 5,538,566, incorporated herein by reference.

Suitability of any given alloy and lubricant formulation is best assessed with the actual fixture to be employed. However, a standard test may be used as follows for a screening test: The thickness of the precursor, which is most often a sheet product, is dictated by the weight and strength properties of the finished part, and the deepness of the various sections formed.

The preferred substrates in the warm forming process are aluminum and magnesium alloys, preferably aluminum alloys. The increasing demands upon fuel consumption in the transportation sector in particular, dictate increasing use of low density alloy materials as a substitute for heavier materials such as steel. Aluminum is a favored candidate for many applications, however magnesium is being increasingly used as well. Titanium, even though a high cost material, is increasingly considered due to its excellent strength to weight ratio.

The common aluminum and magnesium alloys are often heat treated to alter their grain structure, for example to increase hardness, tensile strength, and ductility. In use of such alloys in warm forming processes, the chemical makeup of the alloy and its thermal history must be considered. For example, when heat treatment has been conducted to produce a uniform distribution of fine precipitates, warm forming at a temperature where these precipitates either dissolve or grow to form larger precipitates may completely undo the benefits of prior heat treatment. One skilled in the metallurgical arts can easily predict what alloys are suitable and at what temperature warm forming should take place. Time is also a factor, since modification of grain structure is not generally rapid, and limiting the time the substrate is "at heat" will consequently widen the window of warm forming temperatures which may be used with any given alloy.

In preferred embodiments, the warm forming lubricant is tightly bound to the substrate, at least after warm forming, and is also receptive to paint. Thus, metals and polar high melting polymers are preferred warm forming lubricants, particularly metals. The metal and polymer lubricants are selected such that they soften or melt under the conditions of warm forming and thereby become lubricious. They are solids at room temperature and modestly elevated temperatures as well. Since considerable pressure is generated during warm forming, it is not essential that melting or softening take place prior to warm forming—it is enough that lubricant properties either previously exist prior to forming or are developed by a combination of temperature and pressure during forming. Some preferred combinations have melting or softening points which are modestly elevated from the warm forming temperature, for example by 5° F. to 50° F.

Metals and metal alloys are preferred lubricants. The metal or metal alloys should be thermally stable in the sense that they are not sufficiently oxidized at elevated temperatures so as to lose their lubricant properties. They must also be thermally stable in the sense that upon heating to the warm forming temperature, the metal lubricant does not alloy with the substrate metal such that the skin of the substrate is alloyed and the lubricant is thus effectively removed by this process.

For example, tin may be applied to aluminum alloys by processes such as chemical and electrochemical plating, by sputtering, dip coating, etc. However, tin is an element which easily dissolves in aluminum at relatively high concentrations. Such the lubricant coating is necessarily thin, upon heating the substrate or "blank", the entire tin coating may diffuse into the aluminum blank, not only modifying its surface qualities, but also thereby losing its effectiveness as a lubricant.

While this phenomenon has been explained relative to aluminum alloys, the same is true of magnesium alloys and steels. For such metal lubricants which easily diffuse into the substrate, it is desirable to introduce a barrier layer or a plurality of barrier layers between the substrate and the metal lubricant, the barrier layer then preventing diffusion or migration of the lubricant into the substrate. As an example, a copper barrier layer may be used between an aluminum alloy blank and a tin lubricant. The copper prevents migration of tin into aluminum for the time necessary to heat the blank and warm form the blank. Following warm forming, none, some, or all of the copper and tin may have alloyed with the aluminum substrate. Such alloying when present, may be desirable, because it ensures that the various coatings will not separate from the substrate. Oxide coatings which are relatively continuous and robust may also be used as a barrier layer, or a combination of an oxide barrier layer and a metal barrier layer. In addition to or in lieu of its barrier function, the "barrier" layer may also serve as an adhesion layer which promotes firm attachment to the substrate of metal subsequently deposited.

In the warm forming operation, a two part, generally relatively heavily contoured mold is used. The "blanks" are heated to warm forming temperature, for example in a heating tunnel or oven, or by infrared light, induction heating, etc. Combinations of these methods may be used. It is most desirable that the time the blank remains at the warm forming temperature is minimized. It is possible in this respect to partially heat the blank to a lower temperature and maintain the blank at this temperature until just before warm forming. For example, when warm forming aluminum alloy at 320° C., it may be desirable to heat the blanks in an air oven (or nitrogen, argon, etc.) to 150° C., and then rapidly heat, for example by infrared radiant heating, to 320° C. just prior to warm forming.

When metals and high melting polar polymers are employed as the warm forming lubricant, the part need not require a washing operation prior to applying paint or other surface coatings. If the mold is treated with oily substances which might impair paint adhesion, a wash with water containing conventional surfactant "degreasers" can be used, or a conventional solvent can be used. Conventional solvents may sometimes swell high melting point polar polymers, but generally will not dissolve them. Polar aprotic solvents are generally necessary for the latter. Some swelling of the polymer may be effective in increasing paint adhesion. The ability to directly paint the formed product is very advantageous, and cannot be accomplished with previously used warm forming lubricants such as phosphate esters and the like. In practice, however, parts are almost always washed prior to painting, no matter what materials they are made of or by what processes, if for no other purpose, to remove dust which might adhere to the part. The advantage to using water for such wash should be clear. A further advantage of the subject invention warm forming lubricants is that deep and highly contoured parts may be made without holes, cracks, or other defects.

To illustrate the concept of the invention, six samples of aluminum alloy sheets were plated first with copper and then with tin. The amounts of copper and tin, in terms of layer thickness. are given in the table below.

| Sample No. | Micro inches Cu. | Micro inches Sn |
|---|---|---|
| 1 | 60 | 30 |
| 2 | 80 | 30 |
| 3 | 100 | 80 |
| 4 | 350 | 120 |
| 5 | 300 | 150 |
| 6 | 400 | 40 |

It was found that sample number 2 gave the best results in terms of thermal stability.

For warm forming of steel, higher temperatures are generally, but not necessarily, required as compared to aluminum and magnesium alloys. Warm forming of steel is disclosed in U.S. Pat. No. 3,557,687, incorporated herein by reference. Even temperatures as low as 120° C. are known to allow deep draw articles to be produced, whereas at room temperature, fracturing is common.

For steel, tin coatings may also be used, but better results are believed to be possible with coatings of nickel and its alloys, for example alloys of nickel and tin, or nickel, copper, and tin. Many alloys are possible, and selection of a given alloy is easily made by preparing a steel blank coated with the alloy and warm forming. The completed part should be free of fractures, holes, and other defects which are undesirable in the part.

The lubricants of the subject invention are all solids at room temperature and somewhat elevated temperatures, for example up to 100° C., more preferably up to 150° C., and most preferably up to 200° C. The warm forming lubricants must be applied to the substrate as a relatively continuous coating, or form a relatively continuous coating during heating to warm forming temperature, or during the warm forming operation itself. The lubricant must adhere strongly to the substrate, either with or without the use of additional layers to increase adhesion.

Polymer dispersions are, in general, unsuitable for use in the present invention, unless upon drying and heating, the dispersed polymer phase flows to form a continuous coating. Lack of a substantially continuous coating has the drawbacks of first, the potential for local fracturing, galling, etc. where coating is absent or present in low amounts, and second, paint adhesion will vary depending upon whether the coating is present or not.

Polar polymers such as polysulfones, polyether carbonates, high melting point polyamides, polyetherketones, polyethersulfones, polyimides and like polymers can be melt extruded onto metal blanks, or if the blank is substantially three dimensional, may be deposited from solution in solvent, solvents such as tetrahydrofuran, dimethylsulfoxide, dimethylformamide, and similar solvents being preferred. As with the case of metal coatings, a plurality of polymers may be used, either in the same layer, for example as a solid polymer solution or interpenetrating network (in both cases, after removal of solvent, or upon solidification if melt-applied), or a series of polymer layers may be used. For example, a polyethersulfone layer may be applied, and then a 4,4-nylon layer may be applied. In general, second polymer layers are applied from the melt or from solution in a solvent which may swell, but does not dissolve the first layer.

The polymers must be polar in order to be firmly adherent to the substrate, and also to subsequently applied paints. Thus, polyethylene waxes, oligomeric polypropylenes, etc., will not serve as proper lubricants. The polar polymers will contain a substantial number of polar groups such as amide, ester, carbamate, urea, sulfone, carbonate, imide, etc. For the same reasons, graphite and polytetrafluoroethylene are unacceptable as lubricants.

Metal coatings may be applied in numerous layers, for example copper on aluminum (barrier layer) followed by successive layers of tin, nickel, etc. At the temperature of warm forming, it is preferably that these multiple layers coalesce, for example by assistance of pressure or by diffusion, to form a combination alloy over at least a portion of the substrate surface.

The thickness of the layers will depend upon the temperature of the warm forming process, the particular alloy, the shape of the mold, particularly with regard to portions with deep draws, and the coating itself. In general, total thickness of the lubricant coating may range from 40 micro inches to 1000 micro inches, more preferably 60 micro inches to 400 micro inches, and most preferably from 100 to 200 micro inches. For the best overall economy, the minimum coating thickness which reliably forms acceptable parts is desired. This thickness is easily determined by one skilled in the art by preparing a series of blanks with different coating thicknesses, and warm forming parts. It should be noted that the term "blank" as used herein includes both the commonly used precut, discrete blanks as well as a continuous coil which may be preferred in some processes. The mold edges, for example, may be configured to sever the edges of the molded part, separating it from a continuous coil or strip.

A preferred lubricant comprises an alloy of tin and aluminum. Tin itself is an exemplary lubricant and low temperatures, but fails at the temperatures of warm-forming when used alone. However, alloys of aluminum and tin can be formulated to provide a very wide range of melting points. Thus, the particular Al/Sn alloy can be chosen specifically for the warm-forming conditions. The Al/Sn alloy may also contain other alloying elements, such as but not limited to B, Ga, Cu, Ni, Li, Na, K, P, AS, Sb, Bi, Co, Mn, Be, Mg, Ba, Sr, Zn, Si, Ge, etc. More preferably, the alloy is substantially Al/Sn, and most preferably essentially Al/Sn, i.e., >80% Al and Sn and >90% Al and Sn, respectively. Tin over a copper barrier layer is also a preferred lubricant.

The alloy can be applied to the metal surface in numerous ways, for example by electroless or electrolytic plating methods, by CVD, by plasma, by sputtering, hot melt coating, or combinations thereof. It is not necessary that the Sn or Sn/Al alloy be fully alloyed at the time of coating. For example, a plurality of individual layers of Sn and Al or of other metals may be applied, with alloying taking place during heating of the substrate during heating prior to forming. For example, alternating layers of electroless tin and sputtered aluminum may be applied, or layers of nickel and tin, nickel and manganese, etc., may be used. Upon heating above the melting point of tin, alloying by solution begins to take place.

The alloy may be fully formed and applied by techniques such as dipping, where the aluminum sheet contacts a molten bath or reservoir of the alloy, or preferably is sputtered onto the aluminum sheet. A series of two or more sputterings may apply a plurality of layers of alloys of different melting points, preferably at least one with a melting point which is just above the temperature to which the sheet will be heated prior to forming. The highest melting alloy is preferably closest to the aluminum substrate.

Alternatively, an alloy may be atomized into fine particles, and these particles applied to the aluminum substrate with a binder. The binder is preferably fugitive, i.e., evaporates at the forming temperature, preferably before the forming temperature is reached, or is non-fugitive but water soluble. Examples of fugitive binars are low melting waxes. Application of vacuum may assist in removing such binders. The waxes are preferably polar, such that any residue not volatilized will exhibit minimum interference with paintability. In the case of use of metal or metal alloy particles, it is imperative that the particles coalesce to form a coherent coating during the warm forming operation, otherwise paintability may be compromised. For this reason, continuous coatings are preferred.

When binders are used, aqueous binders are preferred. These are preferably thermally stable polymers which are also water soluble to the degree that their residue can be removed by a thorough washing with water, hot water, steam, or a combination thereof. Examples include polyvinylpyrrolidone, polyvinyl alcohol, both fully hydrolyzed and partially hydrolyzed, partial acetals of polyvinyl alcohols, polyacrylic acids, polymaleic acids, copolymers of acrylic acid with other monomers, etc. A water solubility >5 g/L is preferred, more preferably >10 g/L, and most preferably 50 g/L or more. In use, an aqueous binder solution is prepared, the Al/Sn particles added, the dispersion sprayed onto the substrate and dried.

Other alloys may in principle also be used, including Sn/Sb alloys, a variety of nickel and nickel/copper alloys, and the like. However, the alloys must be lubricious and should have a melting point below 1000° F. (537.8° C.) when used with aluminum, and preferably above the warm-forming temperature, preferably 5° F. (28° C.) to 40° F. (22.2° C.), more preferably 10° F. (5.6° C.) to 30° F. (16.7° C.), and most preferably 10° F. (5.6° C.) to 20° F. (11.1° C.) above the warm-forming temperature. A principal advantage of such alloys is that they adhere strongly to the aluminum substrate or even become bonded thereto, and thus do not affect paintability.

Some alloys may oxidize at the temperatures of the process, and in some cases this oxide coating may be desired to be removed. Techniques such as acid washes, and in particular blasting with rather soft media such as soda or ground nut shells may be appropriate.

High melting polar thermoplastics may also be used as the lubricant, either alone or with a metal or metal alloy co-lubricant. By "high melting" is meant polymers which exhibit a melting point or melting range which is significantly above 200° C. (500° F.). At temperatures in the warm-forming range, such thermoplastics, though liquid, still have appreciable viscosity. Since due to their polarity they are also strongly attracted to the aluminum substrate, they both remain on the substrate during forming as well as forming a strongly adhering coating which is receptive to paints. Thus, the thermoplastic, particularly when applied as a continuous coating, does not have to be removed from the substrate prior to painting.

Examples of suitable high temperature thermoplastics include but are not limited to polyether ketones (PEK) and polyether-ether ketones (PEEK) and their variants, e.g., PEKK, PEKEK, etc. polyether sulfones (PES), polysulfones, polyarylene sulfides, polyarylene oxides, polyimides, polycarbazoles, and the like.

All these polymers are available commercially. More than one thermoplastic may be used, for example a plurality of thermoplastics with different melting points.

The thermoplastics may be applied molten by traditional coating methods, but preferably are applied either hot or at room temperature dissolved in a minimal amount of solvent to lower the viscosity. Examples of suitable solvents in particular are aprotic polar solvents such as tetrahydrofuran, dimethyl sulfone, dimethylsulfoxide, dimethylacetamide, dimethylformamide, methylene chloride, and the like. Supercritical $CO_2$ may also be used as a solvent. Following application, any solvent is removed. Coating thickness is preferably from 5 μm to 200 μm, more preferably 10 μm to 100 μm.

The polymer lubricants can also be applied by powder coating methods, for example by contacting atomized powder with an aluminum substrate which has been heated to a temperature where the polymer will adhere or even fuse to the substrate. The powder coating may be electrostatically assisted. In this manner, it is possible to avoid both fugitive binders and solvents.

The polymer lubricants may also be applied as a dispersion, preferably an aqueous dispersion containing a minor amount of fugitive binder or paint-receptive binder. Fugitive binders have been described earlier. Paint receptive binders are compounds or lower melting thermoplastics which either do not decompose at warm-forming temperatures or whose decomposition products strongly adhere to the substrate and also to paint, such that these binders need not be removed. Examples include polyesters, polyepoxy resins, and the like.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A process for the warm forming of a metal substrate to form a contoured metal part comprising aluminum, or magnesium, comprising:

a) supplying a blank of said metal coated with at least one barrier coating of a metal different from the metal of the metal substrate or metal oxide, and at least one warm forming lubricating coating selected from the group consisting of metal(s), non-fugitive high melting point polar polymers, and mixtures thereof, said barrier coat effective in reducing migration of the warm forming lubricating coating into the metal substrate, said coating being substantially continuous before warm forming, or developing a substantially continuous coating during the warm forming process;

b) supplying an at least two part mold having a contour in mating mold parts corresponding to the shape of the contoured metal part;

c) heating the blank to a warm forming temperature and positioning the blank in the mold;

d) closing the mold under pressure to form a warm formed part; and e) removing the warm formed part from the mold, wherein the warm forming temperature is less than 1000° F. and also at least 50° C. below the melting point of the metal substrate.

2. The process of claim 1, wherein the metal substrate comprises aluminum, and the coating of warm forming lubricant comprises one or more metal coating layers, at least one coating layer comprising a metal other than aluminum.

3. The process of claim 1, wherein said coating of warm forming lubricant comprises two or more metal coating layers, a first coating layer adjacent the metal substrate and forming an adhesive layer to promote adherence of at least one subsequent coating layer.

4. The process of claim 2, wherein said barrier layer comprises copper metal.

5. The process of claim 4, wherein the metal substrate comprises aluminum, the barrier layer comprises copper, and at least one subsequent layer comprises tin.

6. The process of claim 1, wherein the substrate metal comprises magnesium.

7. The process of claim 1, wherein prior to coating the metal substrate with said coating of warm forming lubricant, the substrate surface is oxidized to form a coherent metal oxide layer.

8. The process of claim 1, wherein the warm forming lubricant softens or melts at or below the warm forming temperature.

9. The process of claim 1, wherein the warm forming lubricant has a melting point at least 10° C. above the warm forming temperature.

10. The process of claim 1, further comprising removing said warm formed part from the mold, washing the part with an aqueous degreaser solution comprising at least one surfactant, rinsing the part with water, drying, and painting the part.

11. The process of claim 1, further comprising painting the part without any intermediate washing step.

12. The process of claim 10, further comprising removing an oxide layer from the part following warm forming by blasting.

13. The process of claim 12, wherein said blasting comprises soda blasting or nut shell blasting.

14. The process of claim 1, wherein the lubricant is applied over an oxide surface of the substrate.

15. The process of claim 1, wherein the coating of warm forming lubricant comprises a high melting point polar polymer.

16. The process of claim 15, wherein the polar polymer lubricant is in powder form and is applied together with a binder to the substrate surface.

17. The process of claim 1 wherein at least one lubricant coating is of metal, and is applied by electroless plating, electroplating, CVD, plasma, sputtering, hot melt coating, or a combination thereof.

18. The process of claim 1, wherein at least one metal lubricant layer is present, and also at least one lubricant layer comprising a high melting point polar polymer.

19. The process of claim 1, wherein in addition to the solid, warm forming lubricant selected from the group consisting of metal(s) and high melting point polar polymers or mixtures thereof, a further lubricant is applied.

* * * * *